United States Patent [19]

Hornsby, Jr.

[11] 4,076,251

[45] Feb. 28, 1978

[54] AMUSEMENT DEVICE INCORPORATING SIMULATED CHEESE AND MICE

[76] Inventor: James R. Hornsby, Jr., 6239 Edgewater Drive, Orlando, Fla. 32810

[21] Appl. No.: 762,640

[22] Filed: Jan. 26, 1977

[51] Int. Cl.[2] ..... A63F 7/10

[52] U.S. Cl. ..... 273/138 R; 273/120 R

[58] Field of Search ..... 273/138 R, 138 A, 120 R, 273/120 A, 86 C, 136 R; 46/43

[56] References Cited

U.S. PATENT DOCUMENTS

| | | | |
|---|---|---|---|
| 613,414 | 11/1898 | Harrison et al. | 273/138 R |
| 1,167,655 | 1/1916 | Passig | 273/120 R |
| 1,176,033 | 3/1916 | Collins | 273/120 R |
| 1,687,775 | 10/1928 | Lestage | 273/138 R |
| 3,173,691 | 3/1965 | Kunneke | 273/120 R |
| 3,184,237 | 5/1965 | Riva | 273/136 R X |

FOREIGN PATENT DOCUMENTS

| | | | |
|---|---|---|---|
| 487,931 | 12/1929 | Germany | 273/120 R |
| 533,753 | 9/1931 | Germany | 273/120 R |

*Primary Examiner*—Harland S. Skogquist
*Assistant Examiner*—Arnold W. Kramer
*Attorney, Agent, or Firm*—Roylance, Abrams, Berdo & Kaul

[57] ABSTRACT

An amusement device including a simulated cheese having inlet orifices for a ball and a plurality of exit orifices some of which receive simulated mice therein, and a random distributing assembly located inside the simulated cheese for randomly directing a ball entering the inlet orifices toward one of the exit orifices. If a mouse is present in the randomly selected exit orifice, it is forced out thereof by the ball. If a mouse is not present, the ball passes through the orifice unimpeded.

10 Claims, 5 Drawing Figures

AMUSEMENT DEVICE INCORPORATING SIMULATED CHEESE AND MICE

The present invention relates to amusement devices and more particularly the invention relates to an amusement device in the form of a competitive game incorporating simulated cheese and mice, wherein each player has a series of simulated mice received in the simulated cheese and, by taking turns, drops a spherical body into the top of the simulated cheese in order to knock the opponents' mice from the cheese.

It is a known fact that children enjoy competitive games in which they can take an active part and in which there is some degree of chance, or mystery. Moreover, children tend to enjoy playing games in which they can perform a certain act and quickly see the result of such act, which tends to hold their attention and increase their enjoyment associated with playing of the game. In addition, children tend to enjoy playing a game which is not overly complicated and which can be completed in a relatively short period of time and then repeated.

Accordingly, it is an object of the present invention to provide a competitive game for children which is easy to play yet provides for the active participation of the players.

Another object is to provide an amusement device or game with a degree of chance or mystery but which can be completed in a relatively short period of time.

Another object is to provide an amusement device for children in which each players' activity provides an immediate result which is readily seen by all players.

Another object is to provide an amusement device which is simple to manufacture, is safe and consists of only relatively few parts.

Another object is to provide an amusement device which has a specific theme, thereby holding the attention of the children who play it.

The foregoing objects are generally attained by providing an amusement device incorporating simulated cheese and mice comprising a base plate; a simulated cheese in the form of a substantially cylindrical body having a closed top portion with a plurality of randomly spaced inlet orifices therein and an open bottom portion, the bottom portion resting on the base plate, the cylindrical body having a plurality of exit orifices on the cylindrical wall thereof spaced above the bottom portion for the reception in at least some of the exit orifices of portions of simulated mice; an inverted conical member, having a central hole therein, disposed in the cylindrical body for the reception of a spherical body deposited in any of the inlet orifices and for directing the body through the central hole; and means for randomly distributing a spherical body from the central hole toward a randomly selected exit orifice, whereby the spherical body passes through the randomly selected exit orifice unimpeded if there is no mouse present therein and forces the mouse out of the randomly selected orifice if a mouse is present therein.

Preferably four children will play the amusement device or game with there being four sets of three exit orifices in the simulated cheese and with each player designating one of these sets as his or her own. Each player than places two simulated mice in any of the three designated orifices and each player takes his or her turn. Each turn consists of rolling of a die which designates one of the randomly spaced inlet orifices on the simulated cheese into which that player places a ball or spherical body. Once the spherical body passes into the simulated cheese a random distributing assembly randomly selects one of the exit orifices through which the spherical body will exit from the simulated cheese. If that exit contains a mouse, the mouse will be forced out of the exit. If there is no mouse present in the exit, the spherical body passes unimpeded through the exit orifice.

The winner of the game is that player who is last to have his or her mouse or mice received in the exit orifices designated as that players', with the remaining players having all their mice knocked out of those players' exit orifices.

The random distributing assembly for randomly selecting the exit orifice through which the spherical body leaves the simulated cheese is basically a disc-shaped member having a convoluted top surface defining a plurality of ramps extending from a central dome to the exit orifices in the simulated cheese. Located above the random distributing assembly is an inverted cone having a central hole located above the central dome, which cone delivers the spherical body from the inlet orifices in the top of the simulated cheese to the random distributing assembly central dome.

Other objects, advantages and salient features of the present invention will become apparent from the following detailed description, which, taken in conjunction with the annexed drawings, discloses a preferred embodiment of the invention.

Referring now to the drawings which form a part of this original disclosure:

Figure 1:
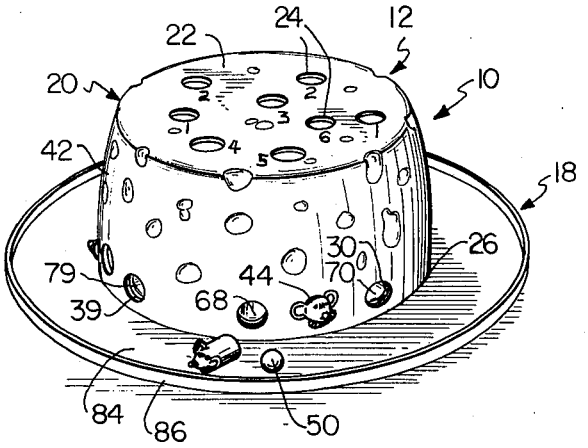
FIG. 1 is a perspective view of the amusement device in accordance with the present invention showing the base plate and the simulated cheese having randomly spaced inlet orifices on the top thereof and a plurality of exit orifices around the side thereof, some of which receive simulated mice therein.
Figure 2:
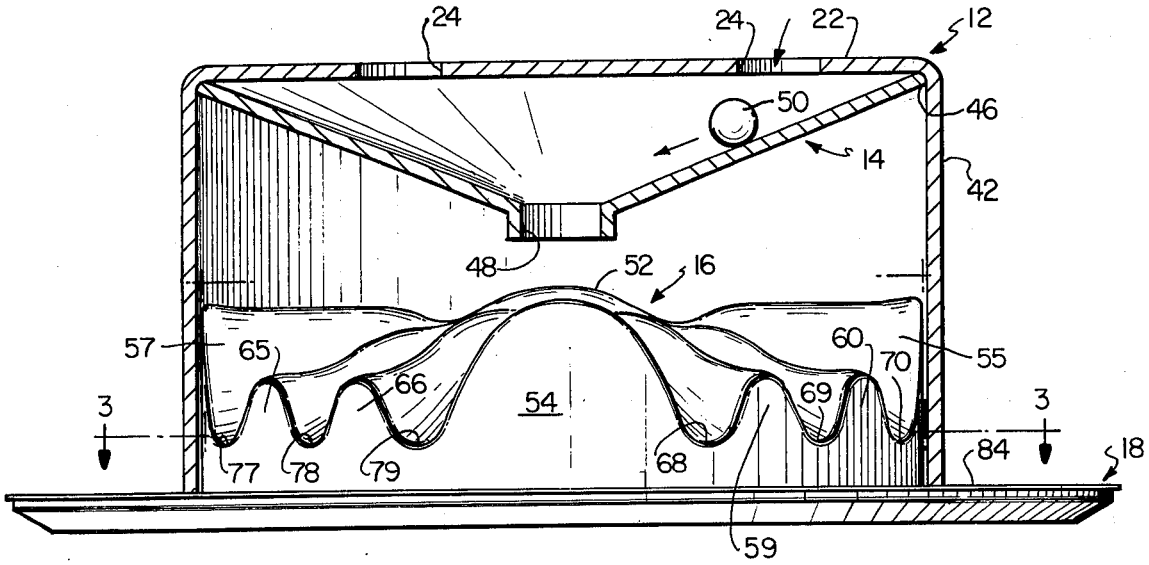
FIG. 2 is a longitudinal sectional view in elevation of the apparatus shown in FIG. 1 showing the convolutions of the random distributing assembly and the inverted cone disposed within the simulated cheese.

Referring now to the drawings in further detail, as shown in FIGS. 1 and 2 the amusement device 10 is basically comprised of a simulated cheese 12, an inverted cone 14 disposed within the cheese, a random distributing assembly 16 disposed within the cheese and below the cone, and a base plate 18 upon which both the simulated cheese 12 and the random distributing assembly 16 rest.

Figure 5:
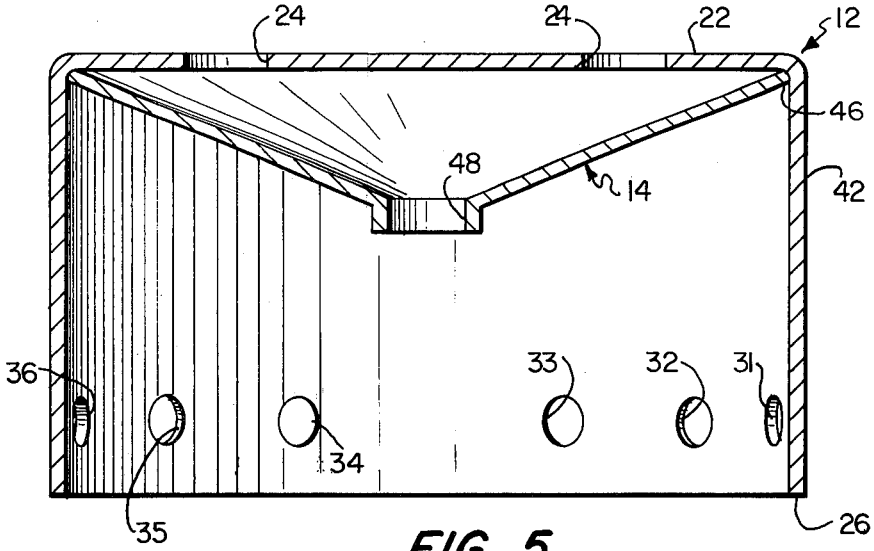
FIG. 5 is a longitudinal sectional view in elevation of the simulated cheese showing the inverted cone disposed therein and showing two sets of the exit orifices located adjacent the bottom portion thereof.

As seen in FIGS. 1 and 5, the simulated cheese 12 is basically in the form of a substantially cylindrical body 20 having a closed top portion 22 with eight randomly spaced inlet orifices 24 therein and an open bottom portion 26, with the bottom portion resting on the base plate 18 as shown in FIG. 1. These eight inlet orifices are numbered 1 through 6 and the two additional orifices repeat the numbers 1 and 2, as shown on the top portion 22 in FIG. 2. As to be described in more detail hereinafter, each player will roll a die numbered from one to six and will place a spherical body in one of the selected inlet orifices, with the option being to place it in any of two of the orifices if either a one or a two is rolled on the die.

Figure 3:
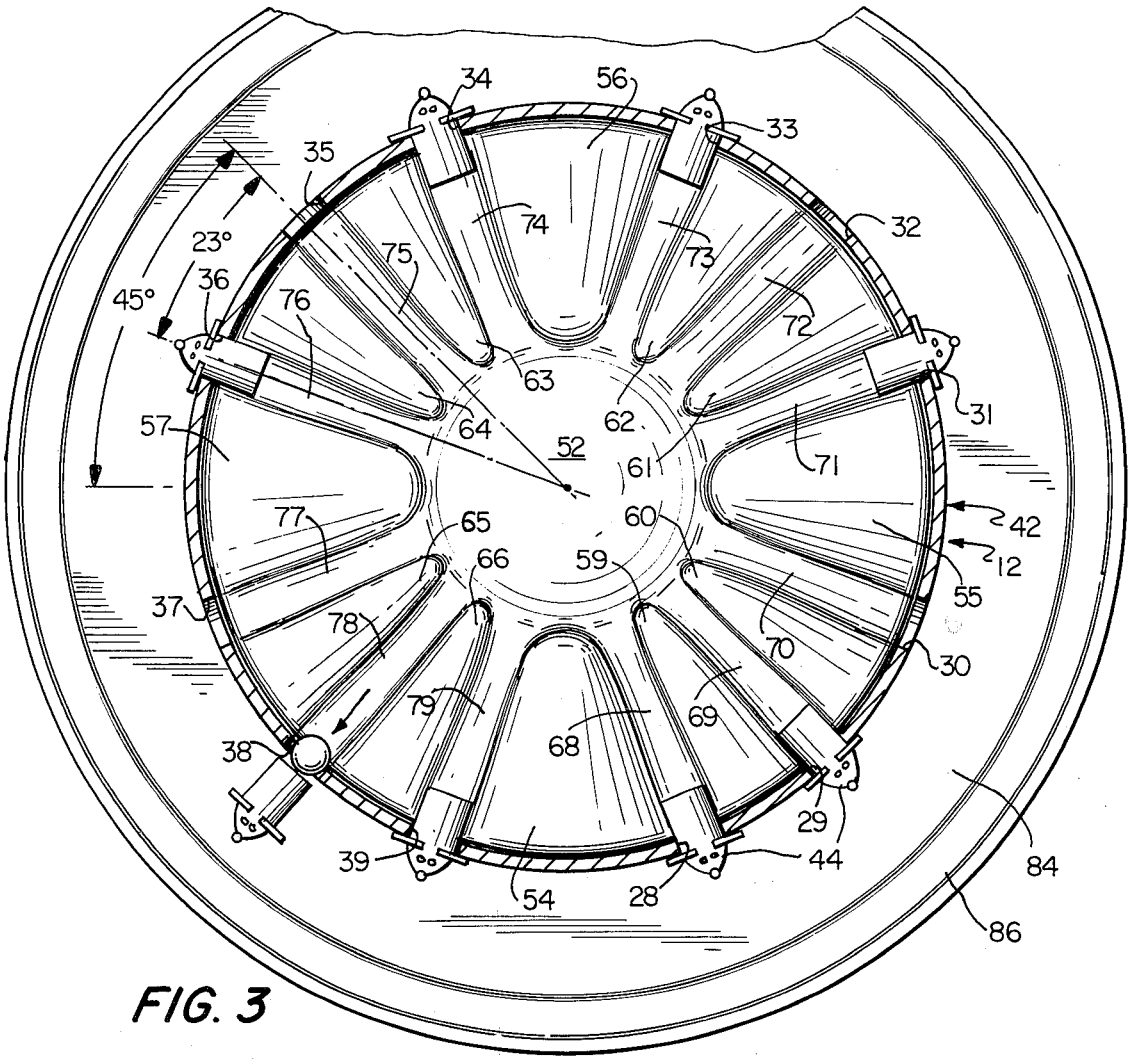
FIG. 3 is a top plan view in section taken along lines 3—3 in FIG. 2 and showing the simulated mice received in the exit orifices of the simulated cheese and supported on the ramps formed by the convolutions of the random distributing assembly.

The cylindrical body 20 has 12 exit orifices, having character numerals 28–39 and best shown in FIG. 3, which exit orifices are in the cylindrical wall 42 of the cylindrical body spaced above the bottom portion 26 for the reception in at least some of them of portions of the simulated mice, each of which is designated by character numeral 44.

As best seen in FIG. 3, the 12 exit orifices are disposed in four sets of three orifices, with each set being associated with one quadrant of the cylindrical body 20. These exit orifices are aligned with the ramps for the spherical body, as to be described in more detail hereinafter.

The simulated cheese 12 is preferably formed of molded plastic, is colored yellow and in addition to the randomly spaced inlet orifices has a plurality of swiss-cheese like indentations on the surface thereof as best seen in FIG. 1.

As seen in FIGS. 2 and 5, the inverted cone 14 is disposed within the simulated cheese 12 with its outer rim 46 being located adjacent the bottom of the top portion 22 of the simulated cheese. This cone 14 can either snap into the cheese 12 or be rigidly secured therein. In any event, the cone 14 has a central hole 48 therein, through which the spherical body or ball 50 may pass.

Referring now to FIGS. 2 and 3, the random distributing assembly 16 has a disc-shape and a convoluted top surface with a central dome 52 at the center thereof, such dome having a radius of about one-third of the assembly's radius. This dome 52 is located below the central hole 48 in the inverted cone 14 and the outer periphery of the disc-shaped assembly 16 lies adjacent the interior of the cylindrical wall 42 of the simulated cheese 12. Assembly 16 has four identical major ridges 54, 55, 56 and 57 spaced at 90° intervals and eight identical minor ridges 59 through 66 with two of the minor ridges being disposed between each adjacent pair of the major ridges. All of these ridges are spaced apart and define ramps therebetween. Thus, as best seen in FIGS. 2 and 3, ramps 68, 69 and 70 form a first set and are defined between ridges 54, 59, 60 and 55; ramps 71, 72 and 73 form a second set and are defined by ridges 55, 61, 62 and 56; ramps 74, 75 and 76 form a third set and are defined by ridges 56, 63, 64 and 57; and ramps 77, 78 and 79 form a fourth set and are defined by ridges 57, 65, 66 and 54. The ramps in each set of three are evenly spaced, each ramp having its centerline at an angle of about 23° relative to the adjacent ramp centerline. The angle between the centerline of a major ridge and the centerline of the middle ramp in the adjacent set of three ramps is about 45°.

As best seen in FIG. 3, each of the ramps slopes downward from the central dome 52 toward a specified, associated exit orifice, for example ramp 68 is associated with exit orifice 28. In broader terms, the ridges and ramps are divided into four identical sets with each set occupying one quadrant of the assembly 16 defined between the centerlines of adjacent major ridges. Thus, each set includes two adjacent halves of two major ridges, the two minor ridges between the adjacent major ridges, and the three ramps defined between the major and minor ridges in that quadrant. As shown in FIG. 3, each set of ridges and ramps is associated with one set of three exit orifices. Preferably, the bottom of each ramp at the outer periphery thereof is adjacent the bottom of the associated exit orifice so that a simulate mouse 44 can be maneuvered from the outside of the simulated cheese 12 through the exit orifice and be supported by the ramp.

Figure 4:
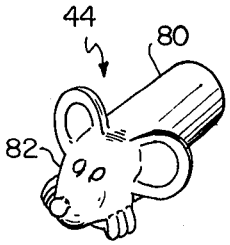
FIG. 4 is a perspective view of one of the simulated mice.

This is shown in FIGS. 1 and 3 with the body portion 80 of the mouse (shown in FIG. 4) being received in the exit orifices and supported on the respective ramp, the face portion 82 of the mouse 44 extending outwardly from the outer surface of the cylindrical wall 42 of the simulated cheese 12.

As best seen in FIGS. 2 and 3, each of the ridges has a curvilinear top surface extending from the central dome radially outward to the cylindrical body wall 42. Each ridge in plane view is substantially in the form of an isosceles triangle with the apex located adjacent the periphery of the central dome and the base located at the outer periphery of assembly 16. Each of the major ridges has a height at the outer periphery thereof about 1.5 times the height of each of the minor ridges at the outer periphery of each. Each major ridge has an outer periphery arc of about 36° and each minor ridge has an outer periphery arc of about 17°.

As seen in FIGS. 2 and 3, the base plate 18 extends outwardly from the cylindrical body wall 42 defining an annular area 84 between the body wall and the outer periphery of the base plate for the reception of the spherical body 50 and the simulated mice exiting from the exit orifices once the game is played. Preferably, a rim 86, shown in FIG. 1 is provided on the outer periphery of the base plate 18 to prevent the spherical body 50 from rolling too far from the game device 10 itself.

Preferably the game is played by four players, each of which chooses one set of three exit orifices as his or her own. In these orifices each player places two mice 44 in any of the three orifices provided. At this time the first player rolls the die and places the spherical body 50 in the inlet orifice having a number corresponding to the number rolled on the die. Once the spherical body enters the simulated cheese 12 via the inlet orifice, it falls onto the inverted cone 14 and rolls through the central hole 48. Thus, placement of the spherical body in any of the inlet orifices results in the spherical body coming to the center of the simulated cheese and dropping from the inverted cone 14 onto the central dome 52 in the random distributing assembly 16.

At this time, the spherical body 50 is randomly distributed to any of the 12 exit orifices by means of the convolutions on the top surface of the assembly 16, the spherical body 50 rolling toward one of the exit orifices via the ramps provided in the assembly 16. Because each of the major ridges is higher than any of the minor ridges, the spherical body is assured of being directed toward one of the exit orifices along the ramps. Since each of the ramps is inclined, with a high point adjacent the central dome 52 and a low point adjacent the exit orifice, the spherical body has sufficient speed so that if a mouse 44 is located in the randomly selected exit orifice at which it is rolling, the spherical body forces the mouse out of the exit orifice. Of course, if the randomly selected exit orifice does not contain a mouse therein, the spherical body leaves the simulated cheese via the exit orifice unimpeded.

As the game continues, each player takes his or her turn dropping a spherical body through one of the inlet orifices and seeing the result of such, which is the forcing out of one of the exit orifices one of that player's mouse, another player's mouse or no mouse at all. This rotation continues until all but one player has had his or her mice forced out of his or her sets of orifices and one remaining player has at least one of his or her mice left in his or her designated orifices.

Thus, a children's amusement device is presented in which the children can take an active part in the competitive game and see an immediate result of their activities, which are made interesting due to the random nature of the elimination of mice from the orifices. Moreover, the game is not unduly complicated and can be quickly completed.

While one advantageous embodiment has been chosen to illustrate the invention, it will be understood by those skilled in the art that various changes and modifications can be made therein without departing from the scope of the invention as defined in the appended claims.

What is claimed is:

1. An amusement device incorporating simulated cheese and mice comprising:

a base plate;

a simulated cheese in the form of a substantially cylindrical body having a closed top portion with a plurality of randomly spaced inlet orifices therein and an open bottom portion, said bottom portion resting on said base plate, said cylindrical body having a plurality of exit orifices on the cylindrical wall thereof spaced above said bottom portion;

at least one simulated mouse of a size and shape to fit releasably into an exit orifice and to be discharged therefrom upon impact by a spherical body, the number of said mice being less than the number of said exit orifices;

an inverted conical member, having a central hole therein, disposed in said cylindrical body for the reception of a spherical body deposited in any of said inlet orifices and for directing said body through said central hole; and means for randomly distributing a spherical body from said central hole toward a randomly selected exit orifice, whereby the spherical body passes through the randomly selected exit orifice unimpeded if there is no mouse present therein and forces the mouse out the randomly selected exit orifice if a mouse is present therein.

2. An amusement device according to claim 1, wherein said means comprises a central dome located below said central hole.

3. An amusement device according to claim 2, wherein said means further comprises a plurality of ramps, each extending from said central dome to one of said exit orifices.

4. An amusement device according to claim 1, wherein said exit orifices are separated into four sets of three exit orifices, each set occupying one quadrant of said cylindrical body wall.

5. An amusement device according to claim 1, wherein said means is disc-shaped and comprises four major ridges spaced at 90° intervals and eight minor ridges, two of said minor ridges disposed between each adjacent pair of major ridges, adjacent minor ridges being spaced apart to define ramps therebetween, each extending to an exit orifice, adjacent minor and major ridges being spaced apart to define ramps therebetween, each extending to an exit orifice.

6. An amusement device according to claim 5, wherein said means further comprises a central dome located below said central hole, said ridges each having a curvilinear top surface extending from said central dome radially outward to said cylindrical body wall.

7. An amusement device according to claim 5, wherein said means is supported on said base plate, and each of said major ridges has a height at the outer periphery thereof greater than the height of each of said minor ridges at the outer periphery of each.

8. An amusement device according to claim 1, wherein said means is disc-shaped and has convolutions on the top thereof, the outer periphery thereof being adjacent to the interior of said cylindrical body wall.

9. An amusement device according to claim 1, wherein each of said simulated mice is comprised of a face portion and a body portion, said body portion being received in said exit orifice with said face portion extending outwardly from said cylindrical body wall.

10. An amusement device according to claim 1, wherein said base plate extends outwardly from said cylindrical body wall defining an annular area between said body wall and the outer periphery of said base plate for the reception of said spherical body and simulated mouse exiting from said exit orifices.

* * * * *